US011035539B2

(12) United States Patent
Shikata et al.

(10) Patent No.: US 11,035,539 B2
(45) Date of Patent: Jun. 15, 2021

(54) VEHICULAR LAMP

(71) Applicant: STANLEY ELECTRIC CO., LTD., Tokyo (JP)

(72) Inventors: Satoshi Shikata, Tokyo (JP); Tomoyuki Imamura, Tokyo (JP); Kazuya Furubayashi, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/418,669

(22) Filed: May 21, 2019

(65) Prior Publication Data

US 2019/0353320 A1 Nov. 21, 2019

(30) Foreign Application Priority Data

May 21, 2018 (JP) ..... JP2018-097290
May 21, 2018 (JP) ..... JP2018-097425

(51) Int. Cl.

*F21S 41/36* (2018.01)
*F21S 41/33* (2018.01)
*F21S 41/25* (2018.01)
*F21S 41/20* (2018.01)

(52) U.S. Cl.

CPC ..... *F21S 41/285* (2018.01); *F21S 41/25* (2018.01); *F21S 41/337* (2018.01); *F21S 41/36* (2018.01)

(58) Field of Classification Search

CPC ..... F21S 41/26; F21S 41/265; F21S 41/337; F21S 41/25; F21S 41/275; F21S 41/285; F21S 41/36; F21S 41/24; F21S 41/295; F21S 41/334

See application file for complete search history.

(56) References Cited

U.S. PATENT DOCUMENTS

2008/0170409 A1 7/2008 Tendo et al.
2012/0106166 A1 5/2012 Chang
2014/0146555 A1 5/2014 Choi et al.
2017/0328535 A1* 11/2017 Yagi ..... F21S 41/663

FOREIGN PATENT DOCUMENTS

EP 2 685 155 A2 1/2014
JP 2017-224475 A 12/2017
JP 2017-228401 A 12/2017

OTHER PUBLICATIONS

Partial Search Report issued in European Application 19175490.2-1012 dated Nov. 12, 2019.

* cited by examiner

*Primary Examiner* — Joseph L Williams
*Assistant Examiner* — Jacob R Stern
(74) *Attorney, Agent, or Firm* — Xsensus LLP

(57) ABSTRACT

A vehicular lamp is capable of projecting light in a forward direction and light in a direction different of the projection lens from the forward direction. The vehicular lamp includes: a light source (3) that emits light forward, and a projection lens (4) that projects light emitted from the light source (3) forward. The projection lens (4) includes a first lens surface (4*a*) located on a side facing the light source (3), and receiving light emitted from the light source (3), a second lens surface (4*b*) located on a side opposite to the first lens surface (4*a*) to output received light forward, and an output portion (14) located on an outer peripheral side surface between the first lens surface (4*a*) and the second lens surface (4*b*) and configured to output a part of light (L') having been incident on and entered through the first lens surface (4*a*) in a direction different from the forward direction.

15 Claims, 16 Drawing Sheets

VEHICULAR LAMP

This application claims the priority benefit under 35 U.S.C. § 119 of Japanese Patent Application No. 2018-097290 filed on May 21, 2018 and Japanese Patent Application No. 2018-097425 filed on May 21, 2018, which are hereby incorporated in its entirety by reference.

TECHNICAL FIELD

The present invention relates to a vehicular lamp.

Conventionally, there has been a vehicular lamp such as a headlamp mounted on the front of a vehicle. Some vehicular lamps include a light source and a projection lens that projects light emitted from the light source forward. In such a vehicular lamp, various forms have been developed by diversification of design (for example, see Japanese Patent Application Laid-Open Nos. 2017-224475 and 2017-228401).

In a conventional vehicular lamp, light emitted from the above-mentioned light source is generally projected forward by a projection lens. For this reason, in one vehicular lamp, when light is projected in a direction different from the forward direction, for example, the side direction, in addition to the forward direction of the projection lens, it is necessary to add a new light source directed in the different direction. Therefore, in this case, problems such as an increase in manufacturing cost due to an increase in the number of light sources and an increase in size due to arranging the light sources in different directions occur.

Further, in the vehicular lamp described above, light distribution characteristics such as visibility and the like can be improved by adding another light distribution in a wide-angle (wide-angle) direction (hereinafter, referred to as wide-angle light distribution) in addition to the light distribution of light projected forward by the projection lens (hereinafter, referred to as main light distribution).

However, similarly to the conventional vehicular lamp described above, it is common to project the light emitted from the light source forward by a projection lens. Therefore, in one vehicular lamp, when a wide light distribution is to be added separately from the main light distribution described above, it is necessary to add a new light source directed in the wide-angle direction. Therefore, also in this case, problems such as an increase in manufacturing cost due to an increase in the number of light sources and an increase in size due to arranging the light sources in different directions occur.

SUMMARY

The present invention was devised in view of these and other problems and features n association with the conventional art. According to an aspect of the presently disclosed subject matter, there can be provided a vehicular lamp capable of projecting light in a direction different from the forward direction in addition to the forward direction of the projection lens.

In order to achieve the above object, the present invention provides the following aspects.

According to a first aspect of the present invention, a vehicular lamp can include: a light source configured to emit light in a forward direction; and a projection lens configured to project light emitted from the light source in the forward direction, wherein the projection lens includes a first lens surface which is located on a side facing the light source, and on which light emitted from the light source is incident, a second lens surface which is located on a side opposite to the first lens surface and configured to output light having been incident on and entered through the first lens surface in the forward direction, and an output portion which is located on an outer peripheral side surface between the first lens surface and the second lens surface and configured to output a part of light having been incident on and entered through the first lens surface in a direction different from the forward direction.

In a second aspect, the vehicular lamp according to the first aspect may be configured such that the output portion has a refracting surface configured to refract light incident on the output portion.

In a third aspect, the vehicular lamp according to the first or second aspect may be configured to include a light guiding lens disposed between the light source and the projection lens, wherein the light guiding lens includes an incident surface which is located on the side facing the light source, and on which light emitted from the light source is incident, an output surface which is located on the side facing the projection lens and configured to output light having been incident on and entered through the incident surface toward the projection lens, and a reflection portion which is located on an outer peripheral side surface between the incident surface and the output surface and configured to reflect a part of light having been incident on and entered through the incident surface toward the output surface, wherein the light reflected by the reflection portion is output from the output surface in a wider angle direction than a direction in which the light entering through the incident surface is directly directed to the output surface.

In a fourth aspect, the vehicular lamp according to the third aspect may be configured such that the light guiding lens is disposed adjacent to the projection lens, and the output surface has a shape along the first lens surface.

Further, it is an object of the present invention to provide a vehicular lamp capable of projecting light in a wide-angle direction in addition to the front of the projection lens.

In order to achieve the above object, the present invention provides the following aspects.

According to a fifth aspect of the present invention, a vehicular lamp can include a light source configured to emit light in a forward direction;

a projection lens configured to project light emitted from the light source forward; and a light guiding lens disposed between the light source and the projection lens, wherein the light guiding lens includes an incident surface which is located on a side facing the light source, and on which light emitted from the light source is incident, an output surface which is located on a side facing the projection lens and configured to output light having been incident on and entered through the incident surface toward the projection lens, and a reflection portion which is located on an outer peripheral side surface between the incident surface and the output surface and configured to reflect a part of light having been incident on and entered through the incident surface toward the output surface, and the light reflected by the reflection portion is output from the output surface in a wider angle direction than a direction in which the light entering through the incident surface is directly directed to the output surface.

In a sixth aspect, the vehicular lamp according to the third or fifth aspect is configured such that the reflection portion has a plurality of reflection cuts on the outer peripheral surface of the light guiding lens.

In a seventh aspect, the vehicular lamp according to the third, fifth, or sixth aspect is configured such that the light guiding lens has an outer shape smaller than that of the projection lens and has an optical axis that coincides with an optical axis of the projection lens.

In an eighth aspect, the vehicular lamp according to the fifth, sixth or seventh aspect is configured such that the projection lens includes a first lens surface which is located on a side facing the light source, and on which light emitted from the light source is incident, and a second lens surface which is located on a side opposite to the first lens surface and configured to output light having been incident on and entered through the first lens surface in the forward direction, the light guiding lens is disposed adjacent to the projection lens, and the output surface of the light guiding lens has a shape along the first lens surface.

In a ninth aspect, the vehicular lamp according to the fourth or eighth aspect is configured such that the first lens surface and the second lens surface are each a convex surface, and the incident surface is a flat surface and the output surface is a concave surface.

In a tenth aspect, the vehicular lamp according to any one of the first to ninth aspect is configured such that the light source includes a plurality of light emitting elements and a circuit board on which the plurality of light emitting elements are mounted, and the plurality of light emitting elements are mounted on the same surface of the circuit board.

As described above, according to the present invention, it is possible to provide a vehicular lamp capable of projecting light in a direction different from the forward direction, for example, in a wider-angle direction, in addition to the forward direction of the projection lens.

BRIEF DESCRIPTION OF DRAWINGS

These and other characteristics, features, and advantages of the present invention will become clear from the following description with reference to the accompanying drawings, wherein.

DESCRIPTION OF EXEMPLARY EMBODIMENTS

Figure 1:
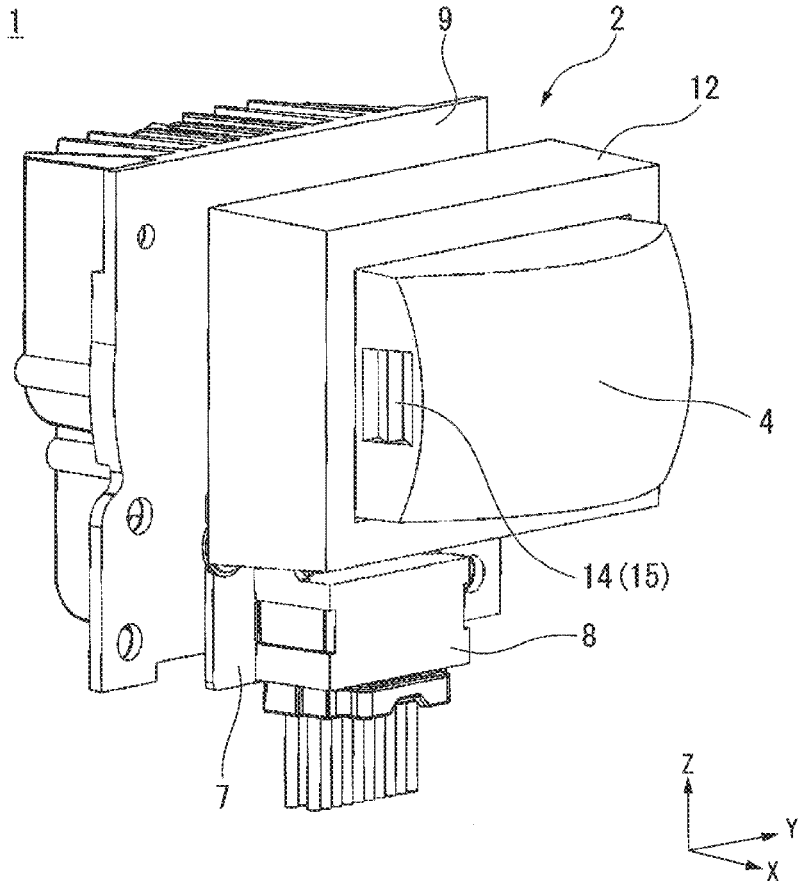
FIG. 1 is a perspective view showing an appearance of a vehicular lamp according to a first embodiment of the present invention.

A description will now be made below to vehicular lamps of the present invention with reference to the accompanying drawings in accordance with exemplary embodiments.

In the drawings used in the following description, in order to make each component easy to see, the scale of the dimension may be shown differently depending on the component, and the dimensional ratio of each component is not necessarily the same as the actual ratio.

In the drawings shown below, the XYZ orthogonal coordinate system is set, and the X-axis direction is indicated as the front-rear direction (length direction) of the vehicular lamp, the Y-axis direction is indicated as the left-right direction (width direction) of the vehicular lamp, and the Z-axis direction is indicated as the vertical direction (height direction) of the vehicular lamp.

First Embodiment

First, as a first embodiment of the present invention, for example, a vehicular lamp 1 shown in FIGS. 1 to 7 will be described.

Figure 2:
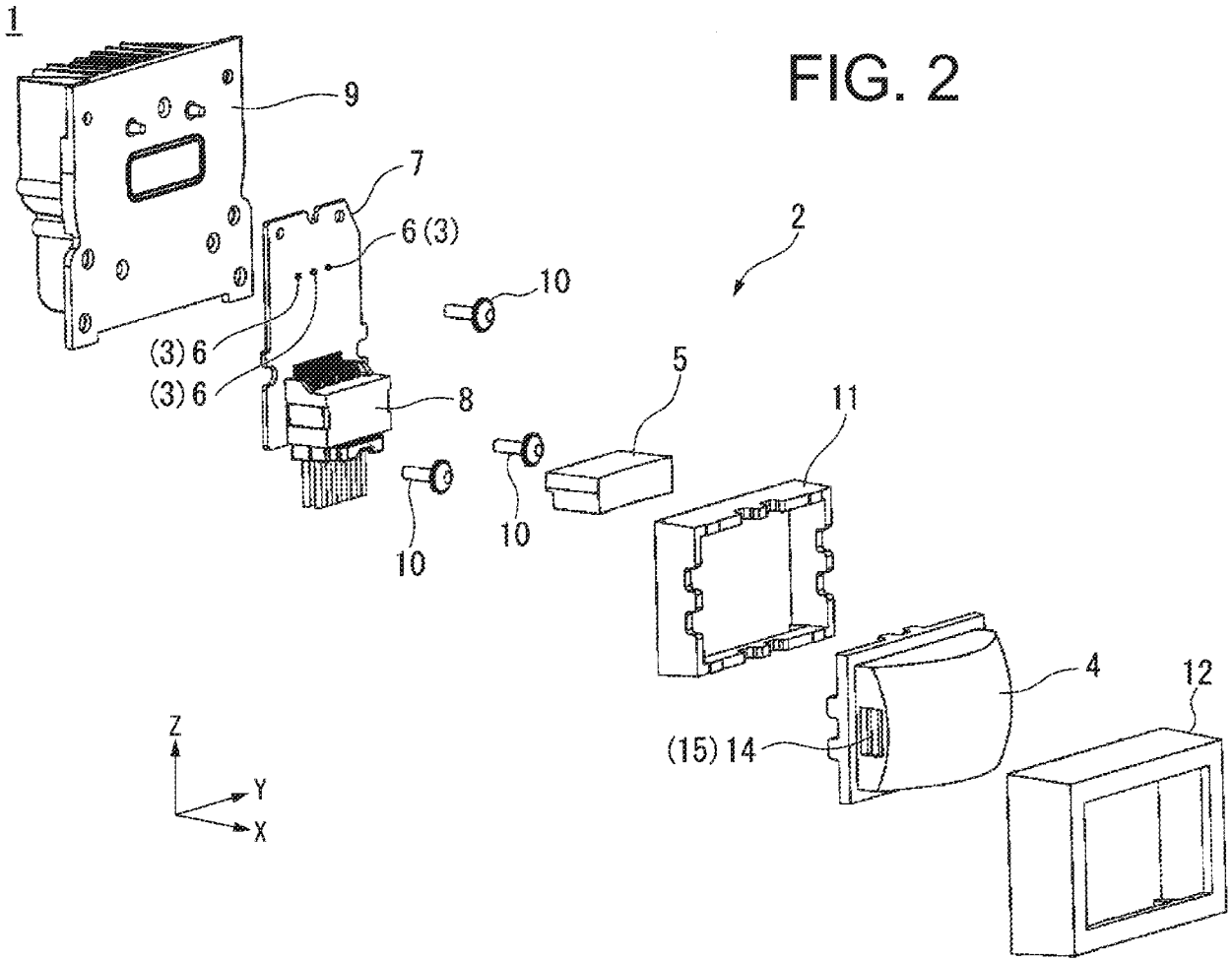
FIG. 2 is an exploded perspective view showing a configuration of the vehicular lamp shown in FIG. 1.
Figure 3:
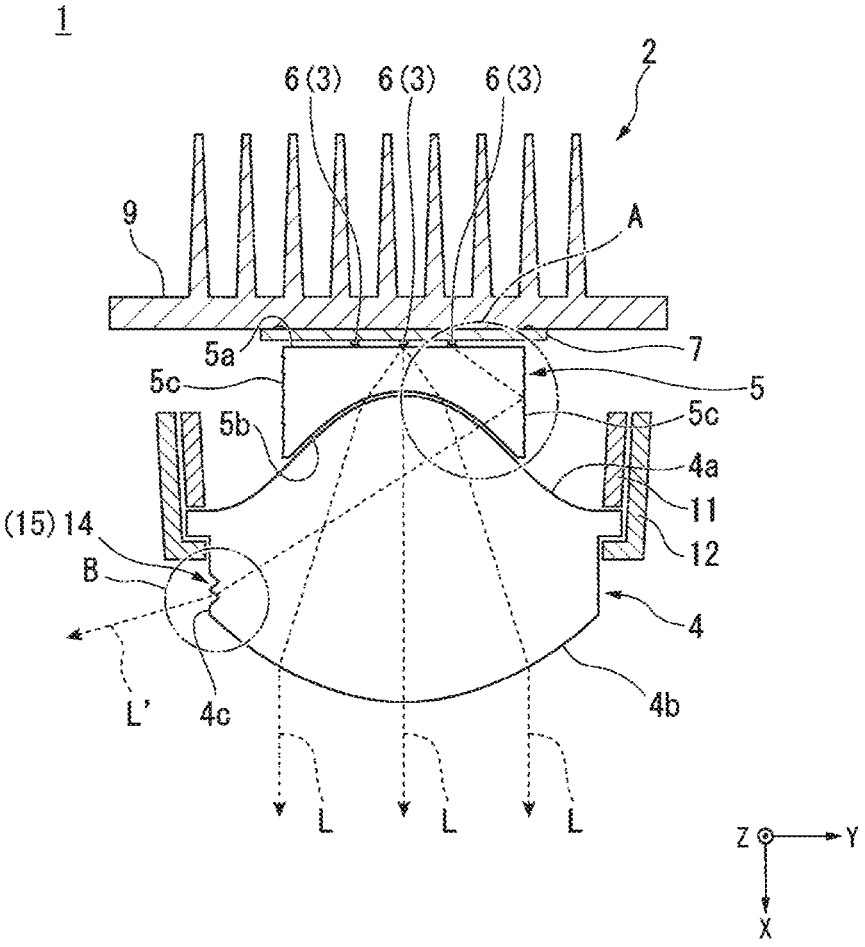
FIG. 3 is a horizontal cross-sectional view showing the configuration of the vehicular lamp shown in FIG. 2.
Figure 4:
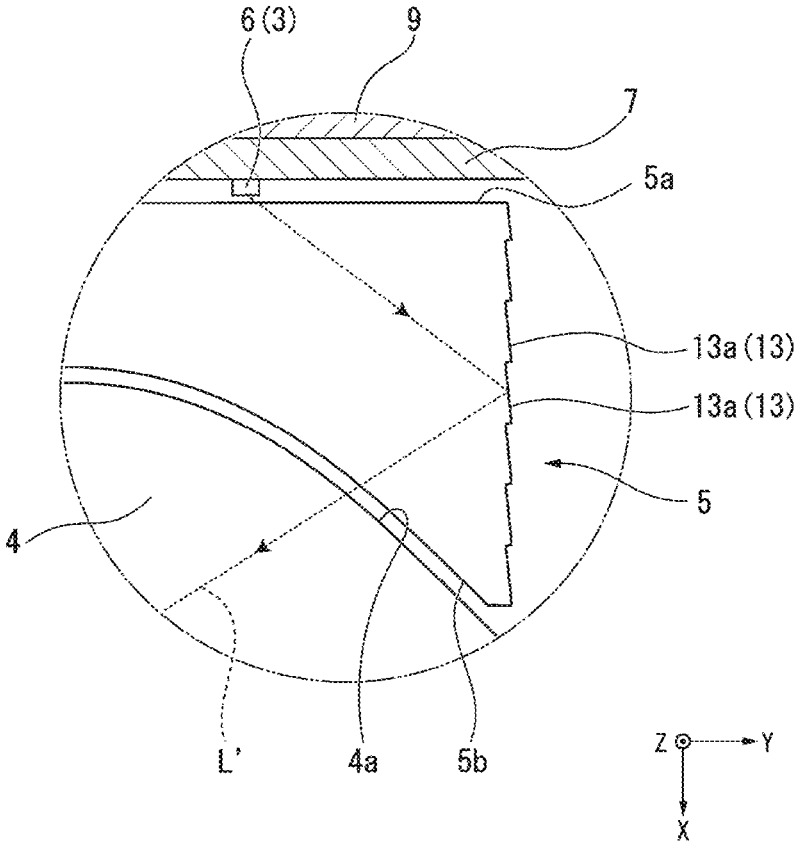
FIG. 4 is a cross-sectional view of the main part of a light guiding lens in which the enclosed portion A shown in FIG. 3 is enlarged.
Figure 5:
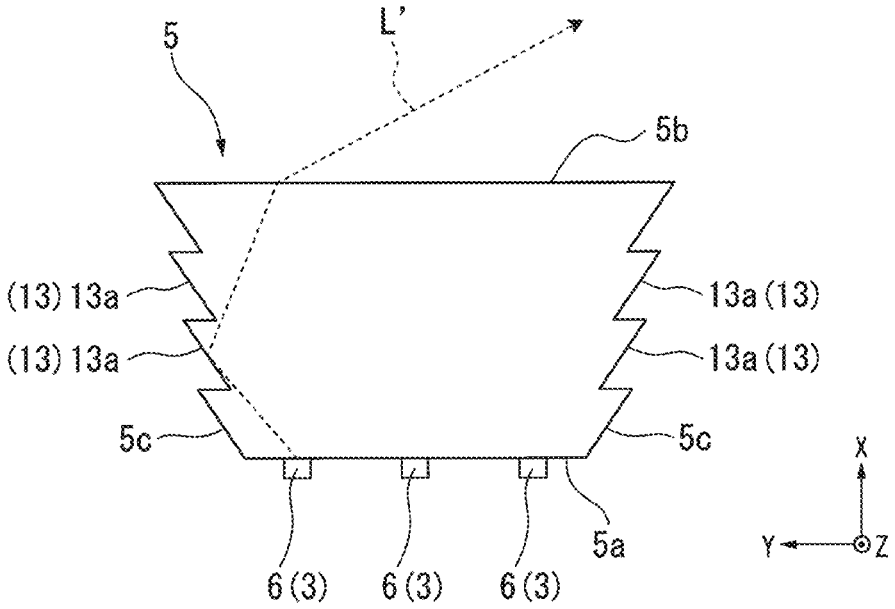
FIG. 5 is a cross-sectional view showing the configuration of the light guiding lens included in the vehicular lamp shown in FIG. 1.
Figure 6:
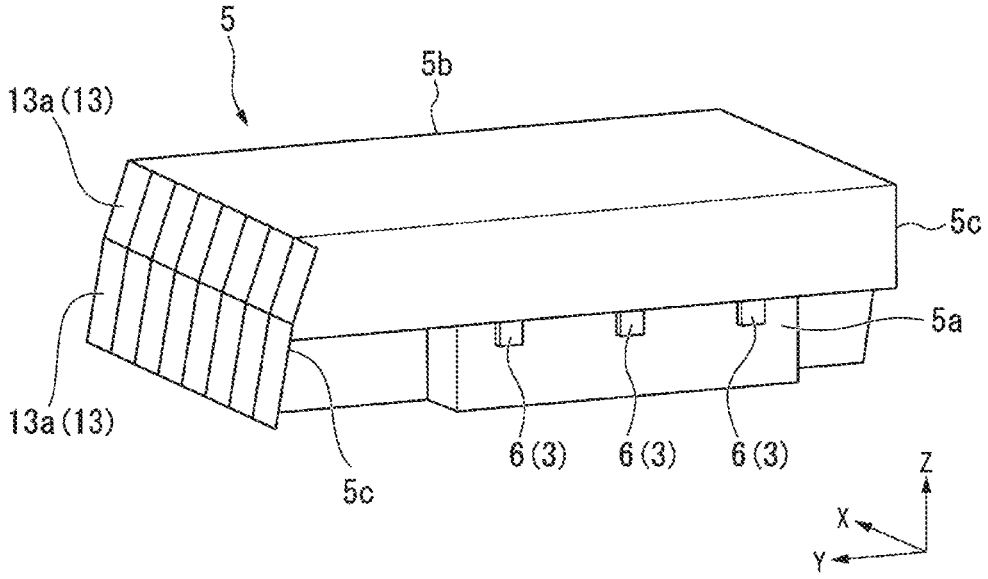
FIG. 6 is a perspective view showing the configuration of the light guiding lens included in the vehicular lamp shown in FIG. 1.
Figure 7:
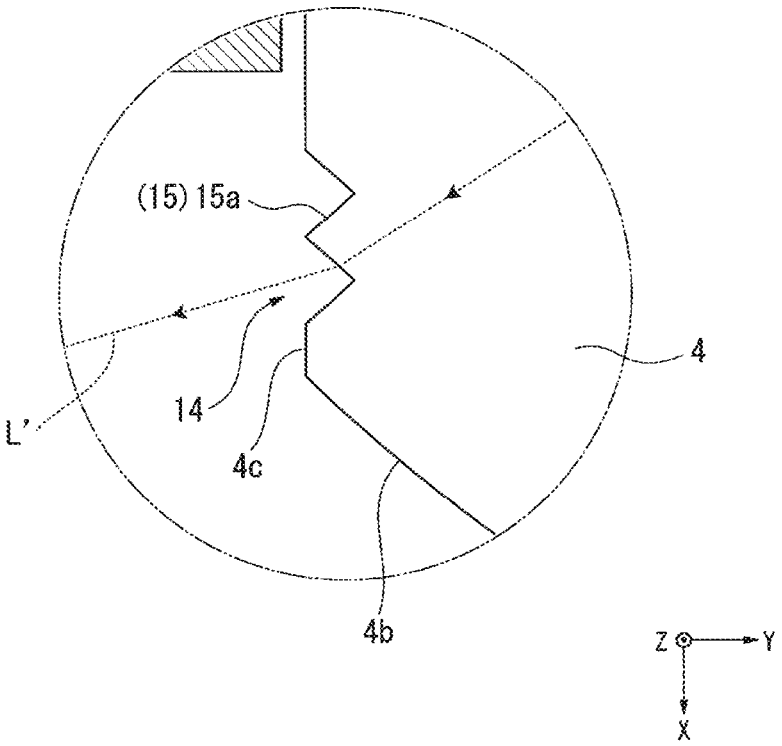
FIG. 7 is a cross-sectional view of the main part of the projection lens in which the enclosed portion B shown in FIG. 3 is enlarged.

FIG. 1 is a perspective view showing the appearance of the vehicular lamp 1. FIG. 2 is an exploded perspective view showing the configuration of the vehicular lamp 1. FIG. 3 is a horizontal cross-sectional view showing the configuration of the vehicular lamp 1. FIG. 4 is a cross-sectional view of the main part of a light guiding lens 5 in which the enclosed portion A shown in FIG. 3 is enlarged. FIG. 5 is a cross-sectional view showing the configuration of the light guiding lens 5 included in the vehicular lamp 1. FIG. 6 is a perspective view showing the configuration of the light guiding lens 5 included in the vehicular lamp 1. FIG. 7 is a cross-sectional view of the main part of a projection lens 4 in which the enclosed portion B shown in FIG. 3 is enlarged.

In the vehicular lamp 1 of the present embodiment, for example, the present invention is applied to a vehicular headlamp mounted on both corner portions on the front end side of a vehicle body (not shown).

In the following description, the terms "front," "rear," "left," "right," "upper," and "lower" refer to the respective directions when the vehicular lamp 1 is viewed from the front (the front of the vehicle), unless otherwise specified.

The vehicular lamp 1 of the present embodiment includes a light source unit 2 as shown in FIGS. 1, 2, and 3. The vehicular lamp 1 has a structure in which the light source unit 2 is disposed inside a lamp body composed of a housing having an open front surface (not shown) and a transparent lens cover covering the opening of the housing.

The light source unit 2 includes a light source 3 that emits light L toward the front (forward), a projection lens 4 that projects light L emitted from the light source 3 toward the front, and a light guiding lens 5 disposed between the light source 3 and the projection lens 4.

The light source 3 has a plurality of (three in this embodiment) light emitting elements 6 and a circuit board 7 provided with a driving circuit (not shown) for driving the plurality of light emitting elements 6. The light source 3 projects the light L emitted by each light emitting element 6 radially forward.

Each of the light emitting elements 6 is, for example, a light emitting diode (LED) that emits white light (light L). Examples of such LEDs may include high-power (high-brightness) LEDs (e.g., SMD LED) for vehicular illumination.

The plurality of light emitting elements 6 are mounted on the front surface of the circuit board 7. The plurality of light emitting elements 6 are arranged at equal intervals in a width direction of the circuit board 7. A connector 8 for electrically connecting to the outside is attached to the front side of the circuit board 7.

On the other hand, a heat sink 9 for dissipating heat generated by the plurality of light emitting elements 6 is attached to the rear surface side of the circuit board 7. The circuit board 7 is fixed (screwed) to the front side of the heat sink 9 using a plurality of (three in this embodiment) screws 10.

Although the light source 3 has a configuration in which a plurality of light emitting elements 6 are mounted on the above-described circuit board 7, a substrate (mounting board) on which the plurality of light emitting elements 6 are mounted and a substrate (circuit board) on which a drive circuit is provided may be separately arranged, and the mounting board and the circuit board may be electrically connected via a wiring code called a harness to protect the drive circuit from heat generated by the plurality of light emitting elements 6.

The projection lens 4 has a first lens surface 4*a* which is located on the side (rear side) facing the light source 3, and a second lens surface 4*b* which is located on the side (front side) facing the first lens surface 4*a*. The projection lens 4 enlarges and projects the light L from the light source 3 toward the front of the vehicle body (forward).

The first lens surface 4*a* is a convex surface on which the light L emitted from the light source 3 is incident. The first lens surface 4*a* has a convex shape curved in the left-right direction (Y-axis direction) and the up-down direction (Z-axis direction). The second lens surface 4*b* is a convex surface that outputs the light L entering through the first lens surface 4*a* forward. The second lens surface 4*b* has a convex shape curved in the left-right direction (Y-axis direction) and the up-down direction (Z-axis direction).

The projection lens 4 is sandwiched between the rear holder 11 and the front retainer 12, and the outer periphery thereof is retained by the holder 11 and the retainer 12. The projection lens 4 in this state is disposed in front of the light guiding lens 5.

The light guiding lens 5 has an outer shape smaller than that of the projection lens 4, and is disposed adjacent to the projection lens 4 in a state in which the optical axis of the projection lens 4 coincide with each other, i.e., has its optical axis coinciding with the optical axis of the projection lens 4. The light guiding lens 5 has an incident surface 5*a* which is located on the side (rear side) facing the light source 3, an output surface 5*b* which is located on the side (front side) facing the projection lens 4, and a reflection portion 13 which is located on the outer peripheral side surface 5*c* between the incident surface 5*a* and the output surface 5*b*.

The incident surface 5*a* is a flat plane on which the light L emitted from the light source 3 is incident. The output surface 5*b* is a concave surface configured to output the light L having been incident on and entered through the incident surface 5*a* toward the projection lens 4. The output surface 5*b* has a concave shape curved in the left-right direction (Y-axis direction) and the up-down direction (Z-axis direction) along the first lens surface 4*a* of the projection lens 4. The outer circumferential side 5*c* of the light-guiding lens 5 has a shape that is gradually widened from the incident surface 5*a* side to the output surface 5*b* side.

The reflection portion 13 has a plurality of reflection cuts 13*a* on the outer peripheral side surface 5*c* of the light guiding lens 5. The reflecting portion 13 reflects a part L' of the light L having entered through the incident surface 5*a* toward the output surface 5*b*. In addition, the light L' reflected by the reflecting portion 13 is output from the output surface 5*b* in a wider angle direction than the light L having been incident on and entered through the incident surface 5*a* and directed toward the output surface 5*b*.

As shown in FIG. 4, FIG. 5, and FIG. 6, the plurality of reflection cuts 13*a* are formed of a plurality of stepped surfaces periodically arranged in the front-rear direction of the outer peripheral side surface 5*c*. The stepped surfaces are inclined at angles at which they reflect the light L' having been incident on the outer peripheral side surface 5*c* toward the output surface 5*b*. In the reflecting portion 13, by adjusting the angles of the plurality of step surfaces (reflection cuts 13*a*) in the front-rear direction, the light distribution in the wider angle (wide-angle) direction of the light L' reflected toward the output surface 5*b* can be controlled.

The plurality of reflection cuts 13*a* are formed of a plurality of stepped surfaces divided in the vertical direction of the outer peripheral side surface 5*c*. In the reflecting portion 13, by adjusting the angles in the vertical direction of the plurality of step surfaces (reflection cuts 13*a*) divided in the vertical direction, the light distribution in the vertical direction of the light L' reflected toward the output surface 5*b* can be controlled.

In the present embodiment, light L' reflected toward the output surface 5*b* can be diffused in the vertical direction by the plurality of stepped surfaces (reflection cuts 13*a*) inclined at different angles in the vertical direction.

As shown in FIG. 3 and FIG. 7, the projection lens 4 has an output portion 14 which is located on the outer peripheral side surface 4*c* between the first lens surface 4*a* and the second lens surface 4*b*. The output portion 14 is provided only on one outer peripheral side surface 4*c* corresponding to the side of the vehicle (i.e., outward in the width direction).

The output portion 14 emits a part of the light L' having been incident on and entered through the first lens surface 4*a* in a direction different from the forward direction, that is, the side direction in the present embodiment. That is, the light L' reaching the output portion 14 is the light L' which has been reflected by the reflection portion 13 and then output from the output surface 5*b* in a wide-angle direction.

The output portion 14 has a refracting surface 15 configured to refract the light L' incident on the output portion 14. The refractive surface 15 is composed of a plurality of grooves 15*a* that are formed by cutting the outer peripheral side 4*c* of the projection lens 4 in the vertical direction so as to be arranged in a periodic manner in the front-rear direction of the outer peripheral side 4*c*.

In the present embodiment, for example, a groove portion 15 a having a substantially V-shaped cross section is formed. The refracting surface 15 can control the emission direction of the light L' output from the output portion 14 by adjusting the angle or the like of the inclined surface of each groove portion 15*a*.

Although the present embodiment exemplifies a case where the light L' is projected toward the side of the vehicle (sideward), it is also possible to project the light L' obliquely forward, obliquely rearward, or the like from the output portion 14 as a direction different from the forward direction.

The shape of the refracting surface 15 is not necessarily limited to the shape of the groove 15*a* described above, and the shape of the groove 15*a* can be appropriately changed. In addition to the groove 15*a* described above, the refractive surface 15 may have an irregular shape in which the light L' output from the output portion 14 is diffused by subjecting the outer peripheral side surface 4*c* of the projection lens 4 with a surface processing (concavo-convex processing) such as, for example, texturing, fish-eye cutting, flute cutting, or the like.

In the vehicular lamp 1 of the present embodiment having the above-described configuration, it is possible to project the light L' in a direction different from the forward direction, separately from the light L projected forward by the above-described projection lens 4.

Further, in the vehicular lamp 1 of the present embodiment, even when the light L' is projected in a direction different from the forward direction by the above-described projection lens 4 in addition to the light L projected in the forward direction, it is not necessary to add a separate light source directed in this different direction. Thus, it is possible to downsize the light source unit 2.

Second Embodiment

Next, as a second embodiment of the present invention, a vehicular headlamp 100A shown in FIG. 8, for example, will be described.

Figure 8:
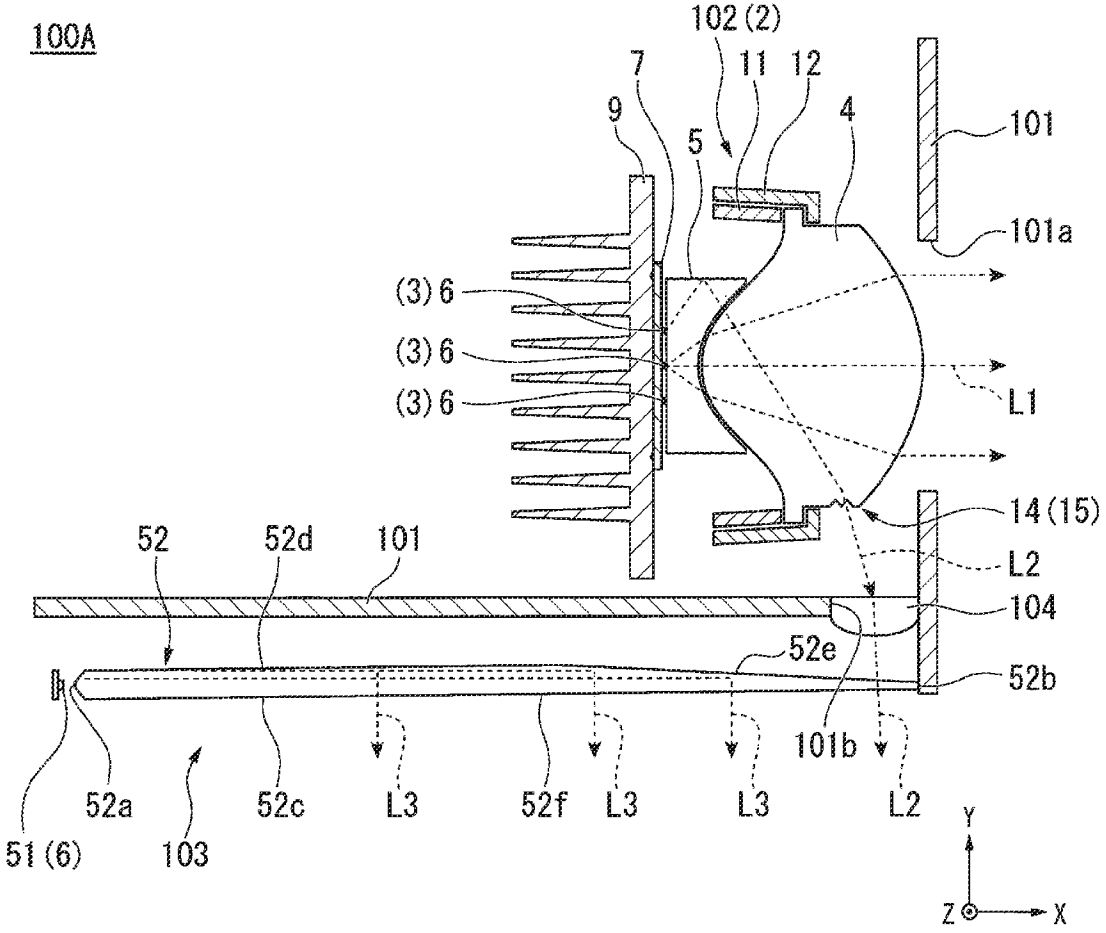
FIG. 8 is a cross-sectional view showing a configuration of a vehicular headlamp as an example of the vehicular lamp according to a second embodiment of the present invention.

FIG. 8 is a cross-sectional view showing the configuration of the vehicular headlamp 100A. In the following description, the description for the same or similar parts as those of the vehicular lamp 1 is omitted, and the same reference numerals are given in the drawings.

As shown in FIG. 8, the vehicular headlamp 100A of the present embodiment includes a first light source unit 102 disposed inside a lamp body 101 and a second light source unit 103 disposed on a side surface of the lamp body 101.

The first light source unit 102 includes the aforementioned light source unit 2. As a result, the first light source unit 102 can output light L2 refracted by the refracting surface 15 laterally from the output portion 14 of the projection lens 4, separately from light L1 projected forward from the projection lens 4.

A front opening 101*a* through which the light L1 projected forward from the projection lens 4 passes is provided on the front surface of the lamp body 101. In addition, a side opening 101*b* that faces the output portion 14 of the projection lens 4 is provided on the side surface of the lamp body 101. The side opening 101*b* is provided with a side lens 104. The side lens 104 is formed of a convex lens and configured to project the light L2 output from the output portion 14 toward the side while condensing light.

The second light source unit 103 includes a light source 51 and a light guide 52 configured to guide light L3 emitted from the light source 51. The light source 51 is composed of one or a plurality of light-emitting elements 6 that emit white light (light L3).

The light guide body 52 has an elongated shape extending in the front-rear direction along the side surface of the lamp body 101. The light guide body 52 has a proximal end surface 52*a* located on the side facing the light source 51, a distal end portion 52*b* located on the opposite side to the proximal end surface 52*a*, an outer peripheral side surface 52*c* and an inner peripheral side surface 52*d* extending between the proximal end surface 52*a* and the distal end portion 52*b*, a notched surface 52*e* formed so as to cut a part of the inner peripheral side surface 52*d* in the extending direction of the inner peripheral side surface 52*d* from the distal end portion 52*b*, and a light output surface 52*f* located on the opposite side to the notched surface 52*e* of the outer peripheral side surface 52*c*.

The proximal end surface 52*a* constitutes an incident portion on which the light L3 emitted from the light source 51 is incident. The incident portion is not limited to the case where the proximal end surface 52*a* is formed of a flat surface, and may be formed of, for example, a lens surface, a prism surface, or the like. Further, the shape of the incident portion of the proximal end surface 52*a* can be appropriately changed in order to collimate or condense the light L3 incident on the proximal end surface 52*a*.

The distal end portion 52*b* is formed into a pointed shape by narrowing the width between the distal end of the notched surface 52*e* and the outer peripheral side surface 52*c* (the light output surface 52*f*).

The notched surface 52*e* constitutes a reflection surface configured to reflect the light L3 incident on the notched surface 52*e* toward the light output surface 52*f*. The notched surface 52*e* is formed by an inclined surface curved toward the distal end portion 52*b* in the extending direction of the inner peripheral side surface 52*d*, i.e., the front-rear direction of the light guide body 52.

Further, the notched surface 52*e* is cut so as to gradually become wider from the proximal end side toward the distal end side. As a result, the amount of light L3 reflected by the notched surface 52*e* is adjusted so as to gradually decrease in amount from the distal end side toward the proximal end side.

The notched surface 52*e* may be provided with a plurality of reflection cuts (not shown) configured to reflect the light L3 incident on the notched surface 52*e* at an angle less than the critical angle with respect to the light output surface 52*f*.

The light output surface 52*f* constitutes an output surface that outputs the light L3 incident on the outer peripheral side surface 52*c* on the side facing the notched surface 52*e* toward its side (sideward). In addition, the light L2 output from the above-described output portion 14 can enter through the notched surface 52*e* (inner peripheral side surface 52*d*) of the light guide body 52 and is output from the light output surface 52*f* (outer peripheral side surface 52*c*) close to the front end toward its side (sideward).

In the light output surface 52*f*, light emission on the distal end side can be made relatively strong and light emission on the proximal end side can be made relatively weak by the lights L2 and L3 output from the light output surface 52*f*. This makes it possible to emphasize the flow (streamlined light emission) of light emitted linearly.

The light output surface 52*f* has a shape reflecting the shape of the outer peripheral side surface 52*c*, but the shape, angle, and the like of the light output surface 52*f* can be appropriately changed in order to change the direction (light distribution) of the light L2 and L3 emitted from the light output surface 52*f*.

In the vehicular headlamp 100A of the present embodiment having the above-described configuration, it is possible to use the first light source unit 102 and the second light source unit 103 described above to project the light L1 toward the front, and to produce a flow (streamlined light emission) of light output linearly by means of the light L2 and L3 output laterally.

Third Embodiment

Next, as a third embodiment of the present invention, a vehicular headlamp 100B shown in, for example, FIG. 9 will be described.

Figure 9:
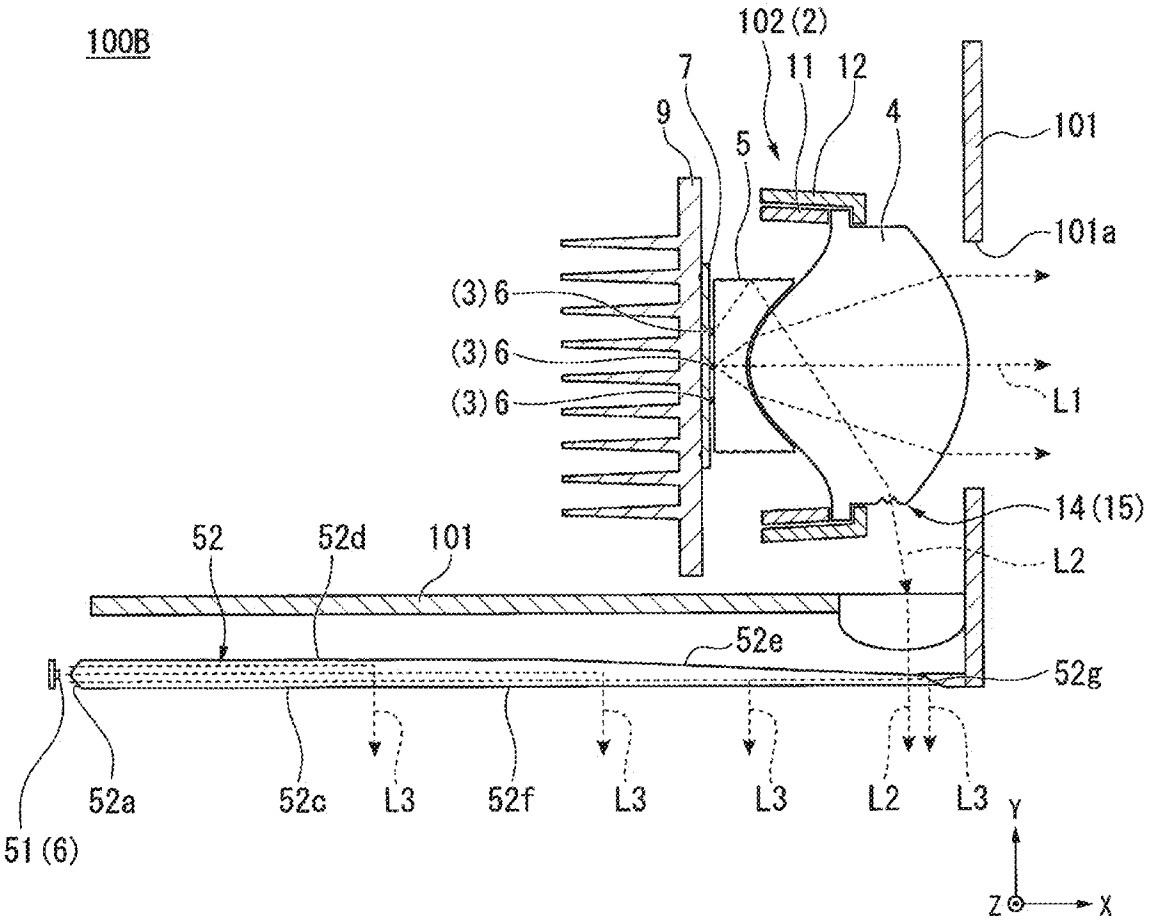
FIG. 9 is a cross-sectional view showing a configuration of a vehicular headlamp according to a third embodiment of the present invention.

FIG. 9 is a cross-sectional view showing the configuration of the vehicular headlamp 100B. In the following description, descriptions of parts equivalent to those of the vehicular headlamp 100A are omitted, and the same reference numerals are assigned in the drawings.

As shown in FIG. 9, the vehicular headlamp 100B of the present embodiment has basically the same configuration as that of the vehicular headlamp 100A except that the shape of the light guide 52 is different from that of the vehicular headlamp 100A.

Specifically, in the present embodiment, instead of forming the distal end portion 52*b* of the light guide body 52 into a pointed shape, a distal end surface 52*g* inclined toward the light output surface 52*f* is provided. The distal end surface 52*g* constitutes a reflection surface configured to reflect the light L3 incident on the distal end surface 52*g* toward the light output surface 52*f*.

With this configuration, when a flow of light (streamlined light emission) emitted linearly is produced by the light L2 and L3 emitted laterally, it is possible to more emphasize the light emission on the distal end side.

In the vehicular headlamp 100B of the present embodiment having the above-described configuration, it is possible to use the first light source unit 102 and the second light source unit 103 described above to project the light L1 toward the front, and to produce a flow (streamlined light emission) of light output linearly by means of the light L2 and L3 output laterally.

Fourth Embodiment

Next, as a fourth embodiment of the present invention, a vehicular headlamp 100C shown in, for example, FIGS. 10 and 11 will be described.

Figure 10:
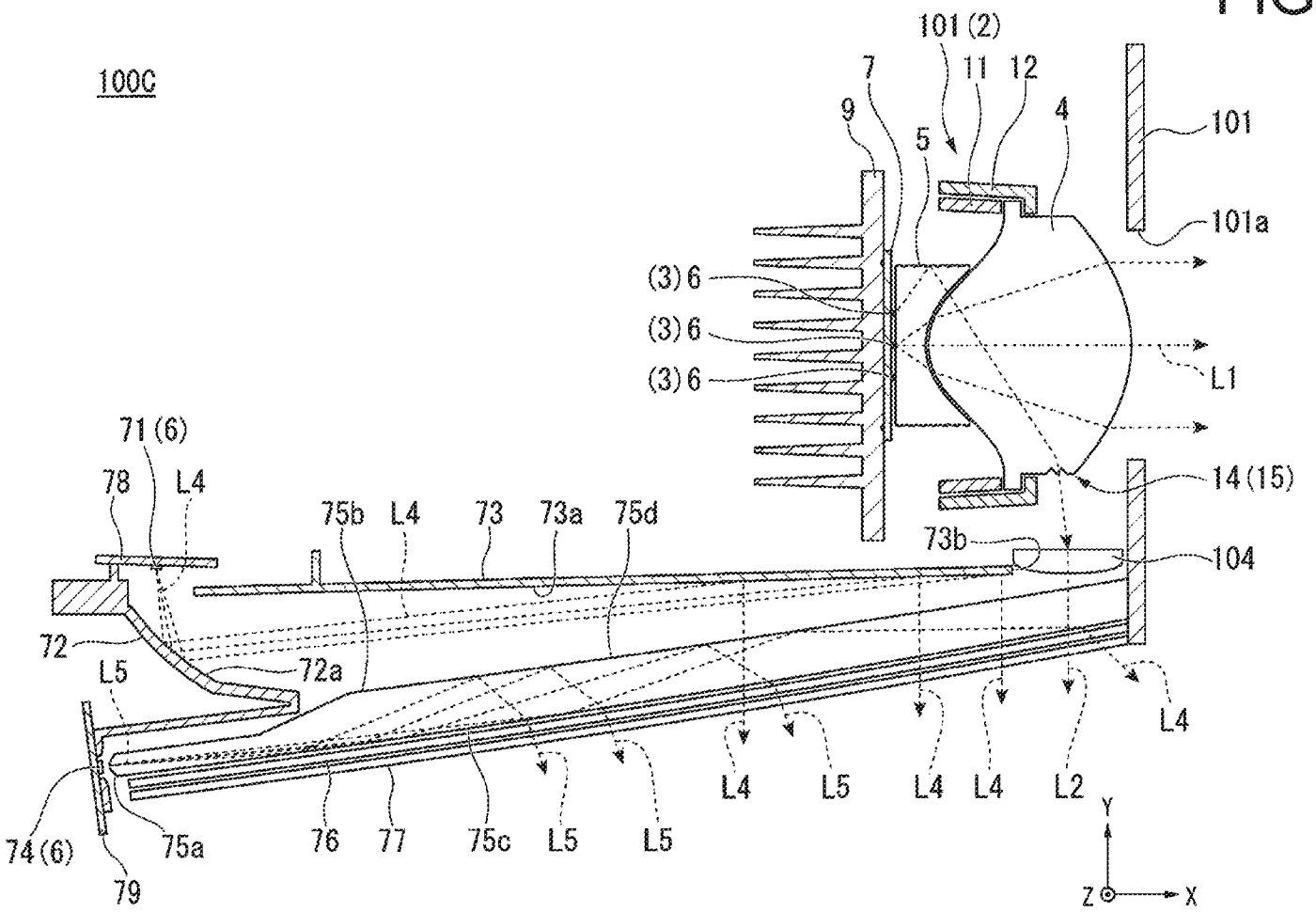
FIG. 10 is a horizontal cross-sectional view showing a configuration of a vehicular headlamp according to a fourth embodiment of the present invention.

FIG. 10 is a horizontal cross-sectional view showing the configuration of the vehicular headlamp 100C. FIG. 11 is a vertical cross-sectional view showing the configuration of the vehicular headlamp 100C. In the following description, descriptions of parts equivalent to those of the vehicular headlamp 100A are omitted, and the same reference numerals are assigned in the drawings.

Figure 11:
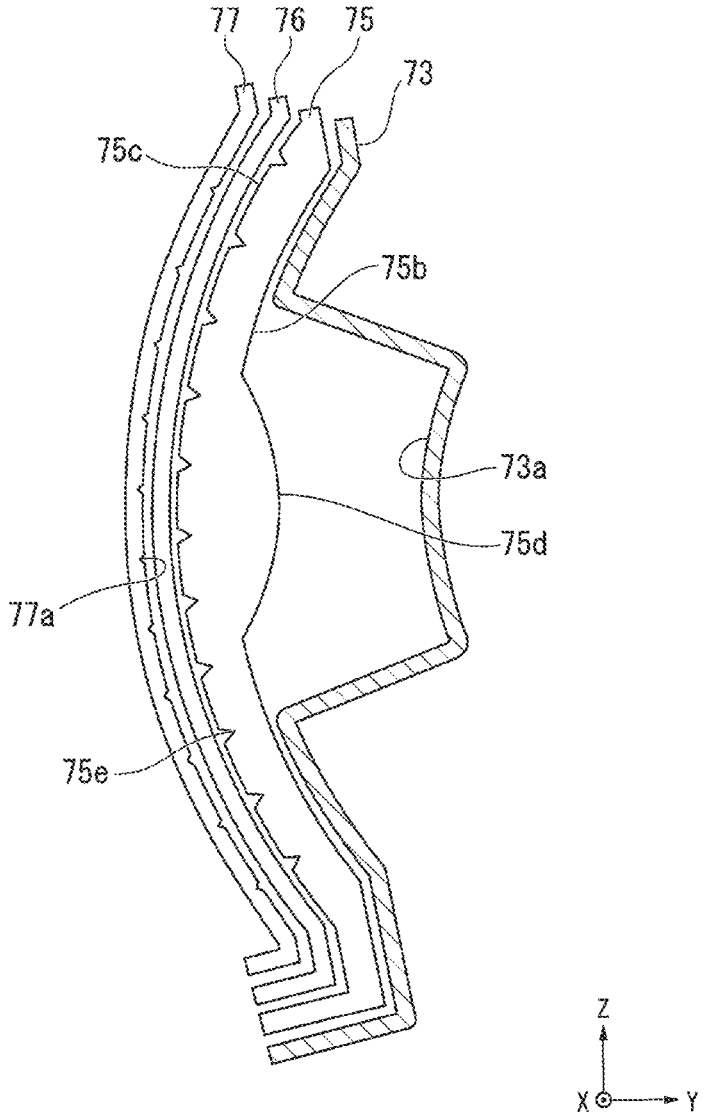
FIG. 11 is a vertical cross-sectional view showing the configuration of the vehicular headlamp shown in FIG. 10.

As shown in FIGS. 10 and 11, the vehicular headlamp 100C of the present embodiment has basically the same configuration as that of the vehicular headlamp 100A except that a second light source unit 105 is provided instead of the second light source unit 103 in the configuration of the vehicular headlamp 100A.

Specifically, the second light source unit 105 includes a first light source 71, a first reflector 72, a second reflector 73, a second light source 74, a first inner lens 75, a second inner lens 76, and an outer lens 77.

The first light source 71 is composed of one or a plurality of light-emitting elements 6 that emit white light, hereinafter referred to as first light L4. The first light source 71 has a structure in which the light emitting element(s) 6 is(are) mounted on the surface of a circuit board 78, and is located on the side surface on the proximal end side of the lamp body 101. As a result, the first light source 71 radially emits the first light L4 of the light emitting element(s) 6 toward the side of the vehicle body (sideward).

The first reflector 72 has a first reflecting surface 72*a* curved concavely so as to draw a parabola having a focal point at or near the location of the light emitting element(s) 6 (light-emitting point). The first reflector 72 is disposed opposite to the first light source 71 and configured to reflect the first light L4 emitted from the first light source 71 (light emitting element(s) 6) while collimating the light with the first reflecting surface 72*a* toward the front side of the vehicle body.

The second reflector 73 has a curved plate shape extending in the front-rear direction while being curved convexly toward the side (outside) facing the first inner lens 75 in the vertical direction (see FIG. 11). The second reflector 73 has a second reflection surface 73*a* in which a plurality of reflection cuts (not shown) are periodically arranged in the front-rear direction. The second reflector 73 reflects the first light L4 reflected by the first reflector 72 toward the side of the vehicle body (toward the first inner lens 75) by the second reflecting surface 73*a*.

The plurality of reflection cuts are formed by periodically arranging groove portions, cut in the vertical direction on the second reflection surface 73*a*, in the front-rear direction. The groove portion has a curved surface shape concavely curved in the width direction. Thus, the plurality of reflection cuts can reflect the first light L4 incident on the grooves toward the side of the vehicle body while diffusing the same in the front-rear direction.

The second reflection surface 73*a* is located between the upper end and the lower end of the second reflector 73, and is provided inside the concave portion 73*b* formed in a rectangular shape in plan view. The second reflection surface 73*a* is provided to extend in the front-rear direction while being convexly curved toward the side (outside) facing the first inner lens 75 in the vertical direction.

In addition, a side opening 73*c* facing the output portion 14 of the projection lens 4 is provided on the distal end side of the second reflector 73. The side opening 73*c* is provided with a side lens 104.

The second light source 74 is composed of one or a plurality of light emitting elements 6 that emit white light, hereinafter referred to as second light L5. The second light source 74 has a structure in which the light emitting element (s) 6 is(are) mounted on the surface of the circuit board 79 so as to face the proximal end side of the first inner lens 75. As a result, the second light source 74 can radially emit the second light L5 of the light emitting element(s) 6 toward the front side of the vehicle body.

The first inner lens 75 has a curved plate shape extending in the front-rear direction while being convexly curved toward the side (outside) opposite to the side facing the second reflector 73 in the vertical direction. The first inner lens 75 is configured to guide the second light L5 emitted from the second light source 74, and output the first light L4 reflected by the second reflector 73 toward the side of the vehicle body, i.e., toward the second inner lens 76.

The first inner lens 75 has, on its proximal end side, an incident portion 75*a* on which the second light L5 emitted from the second light source 74 is incident, a reflection surface 75*b* located on the side (inside) facing the second reflector 73 and configured to reflect the second light L5 incident thereon and having entered through the incident portion 75*a*, and an output surface 75*c* located on the side (outside) facing the second inner lens 76 and configured to output the first light L4 reflected by the second reflector 73 and the second light L5 reflected by the reflection surface 75*b*.

The incident portion 75*a* may be configured, for example, by a lens surface or a prism surface, as well as by a planar configuration. The shape of the incident portion 75*a* can be changed to collimate or condense the second light L5 incident on the incident portion 75*a*.

The reflection surface 75*b* has a plurality of reflection cuts (not shown) periodically arranged in the front-rear direction of the first inner lens 75. The plurality of reflection cuts may take any form as long as they can reflect the second light L5 from the incident portion 75*a* at an angle that is less than the critical angle with respect to the output surface 75*c*. For example, the reflection cut of the present embodiment is constituted by a dot-shaped concave portion.

The first inner lens 75 has a central lens surface 75*d* protruding from a surface (inner surface) facing the second reflector 73 so as to face the second reflecting surface 73*a*. The central lens surface 75*d* is positioned at a substantially central portion of the second inner lens 75 (see FIG. 11), and is provided in a rectangular shape so as to overlap with the concave portion 73*b* in plan view.

The central lens surface 75*d* is convexly curved in the vertical direction and has a shape extending in the front-rear direction. The radius of curvature of the central lens surface 75*d* in the vertical direction is set so that the first light L4 entering through the central lens surface 75*d* is condensed in the vertical direction and then diffused in the vertical direction.

The radius of curvature of the central lens surface 75*d* in the vertical direction gradually increases from the proximal end side to the distal end side of the central lens surface 75*d*. As a result, the degree of diffusion of the first light L4 diffused in the vertical direction by the central lens surface 75*d* gradually decreases from the proximal end side to the distal end side of the central lens surface 75*d*.

The output surface 75*c* has a plurality of groove portions 75*e* for emphasizing the flow (streamlined light emission) of light emitted linearly. The plurality of groove portions 75*e* are formed in a substantially V-shaped cross section, and are provided so as to extend linearly in the front-rear direction of the first inner lens 75. In addition, the plurality of groove portions 75*e* are provided side by side at regular intervals in the vertical direction of the first inner lens 75.

The second inner lens 76 has a curved plate shape extending in the front-rear direction while being curved convexly toward the side (outside) opposite to the side facing the first inner lens 75 in the vertical direction in accordance with the shape of the first inner lens 75. The inner surface or the outer surface of the second inner lens 76 is subjected to, for example, a texturing process or the like. As a result, the second inner lens 76 outputs the first light L4 and the second light L5 emitted from the output surface 75*c* of the first inner lens 75 toward the side of the vehicle body, i.e., toward the outer lens 77, while appropriately scattering the light L4 and L5.

The outer lens 77 has a curved plate shape extending in the front-rear direction while being curved convexly toward the side (outside) opposite to the side facing the second inner lens 76 in the vertical direction in accordance with the shape of the second inner lens 76. The outer lens 77 can outputs the first light L4 and the second light L5 output from the second inner lens 76 toward the side of the vehicle body (sideward).

A surface (inner surface) of the outer lens 77 on the side facing the second inner lens 76 is provided with a plurality of groove portions 77*a* for emphasizing a flow (streamlined light emission) of light emitted linearly. The plurality of groove portions 77*a* are formed in a substantially V-shaped cross section, and are provided so as to extend linearly in the front-rear direction of the outer lens 77. Further, the plurality of groove portions 77*a* are provided side by side in the vertical direction of the outer lens 77 at regular intervals. On the other hand, the surface (outer surface) of the outer lens 77 on a side opposite to the side facing to the second inner lens 76 is formed of a smooth curved surface.

In the vehicular headlamp 100C of the present embodiment having the above-described configuration, it is possible to use the first light source unit 102 and the second light source unit 105 described above to project the light L1 toward the front (forward), and to produce a flow (streamlined light emission) of light emitted linearly by the first light L4 and the second light L5 emitted laterally.

Specifically, in the vehicular headlamp 100C of the present embodiment, by collecting the first light L4 incident on the central lens surface 75*d* described above in the vertical direction and then diffusing it in the vertical direction, the light emission of the central portion corresponding to the central lens surface 75*d* (second reflection surface 73*a*) can be made relatively strong, and the light emission of the upper side and the lower side sandwiching the central portion can be made relatively weak.

In the vehicular headlamp 100C of the present embodiment, the degree of diffusion of the first light L4 diffused in the vertical direction by the central lens surface 75*c* gradually decreases from the proximal end side to the distal end side of the central lens surface 75 *d*, so that the light emission on the distal end side of the portion corresponding to the central lens surface 75*d* (the second reflection surface 73*a*) can be made relatively strong and the light emission on the proximal end side can be made relatively weak.

As a result, in the vehicular headlamp 100C of the present embodiment, it is possible to further emphasize the flow (streamlined light emission) of the second light L5 that is output linearly by means of the first light L4.

As described above, in the vehicular headlamp 100C of the present embodiment, the first light L4 and the second light L5 emitted toward the side of the vehicle can produce the flow (streamlined light emission) of the light emitted linearly (linearly) to be produced, and it is possible to obtain light emission with good appearance.

Fifth Embodiment

As still another embodiment of the present invention, for example, a vehicular lamp 1 shown in FIGS. 12 to 17 will be described. Note that the same or equivalent parts of the present invention will be denoted by the same reference numerals as above.

Figure 12:
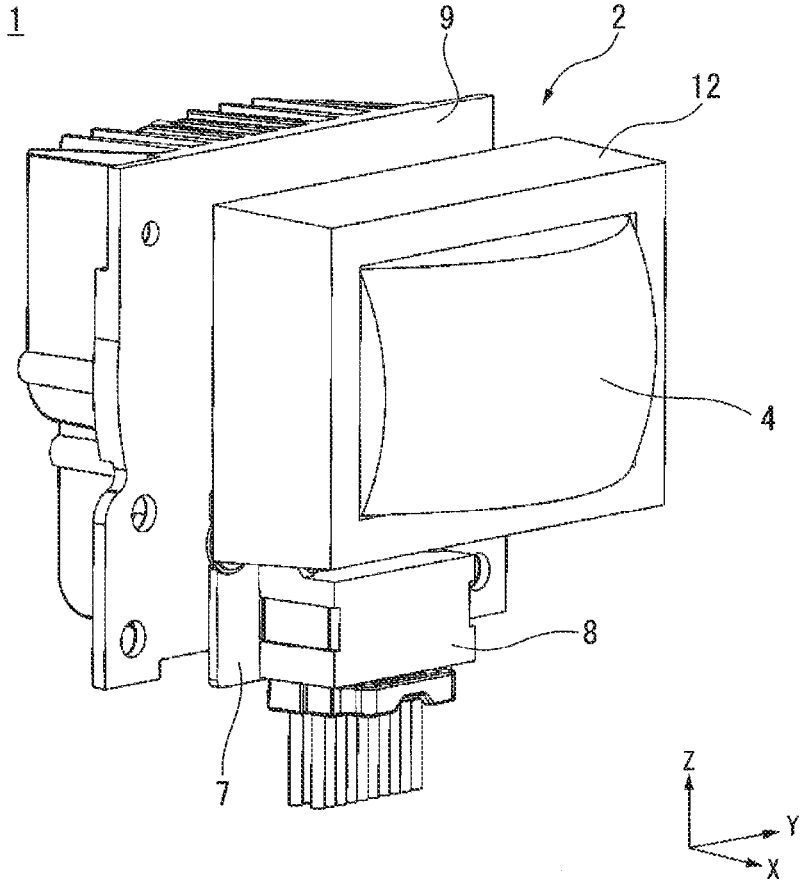
FIG. 12 is a perspective view showing an appearance of a vehicular lamp according to a fifth embodiment of the present invention.
Figure 13:
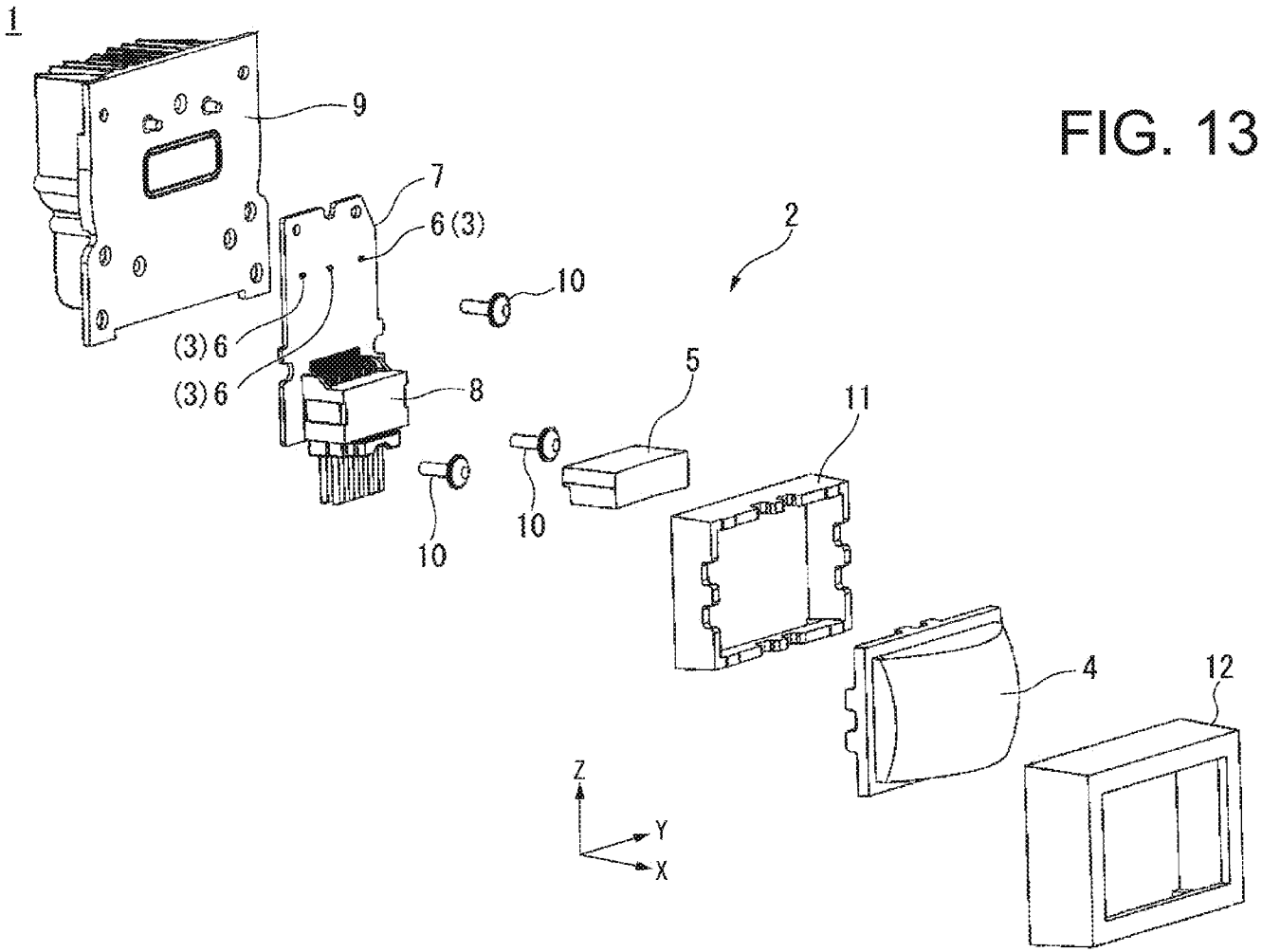
FIG. 13 is an exploded perspective view showing the configuration of the vehicular lamp shown in FIG. 12.
Figure 14:
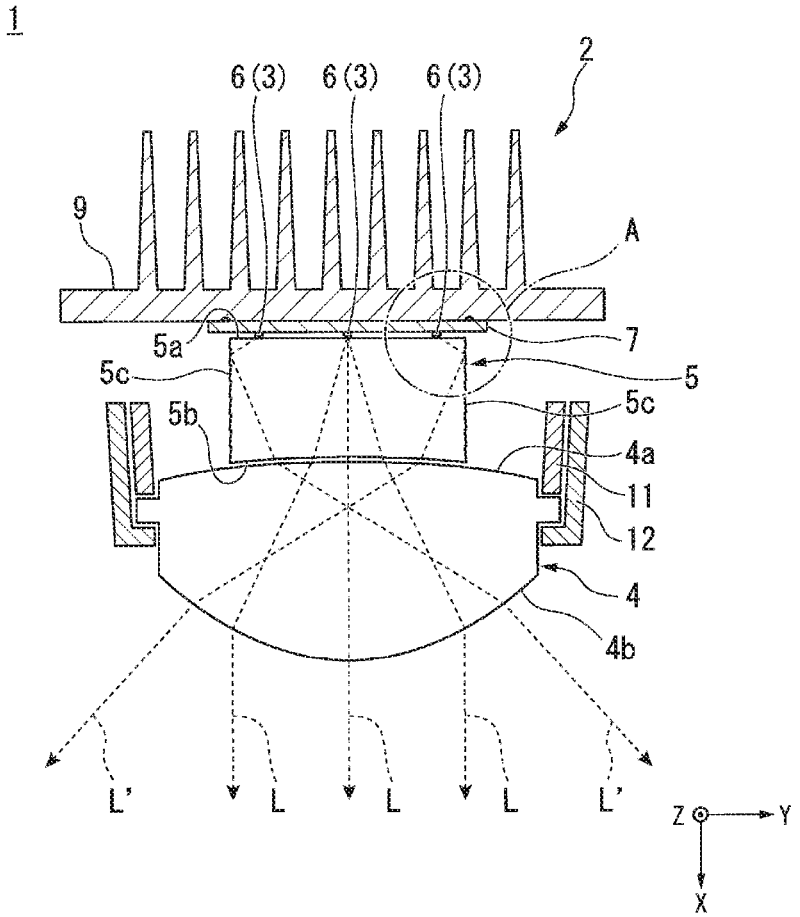
FIG. 14 is a horizontal cross-sectional view showing a configuration of a vehicular lamp according to a fifth embodiment of the present invention.
Figure 15:
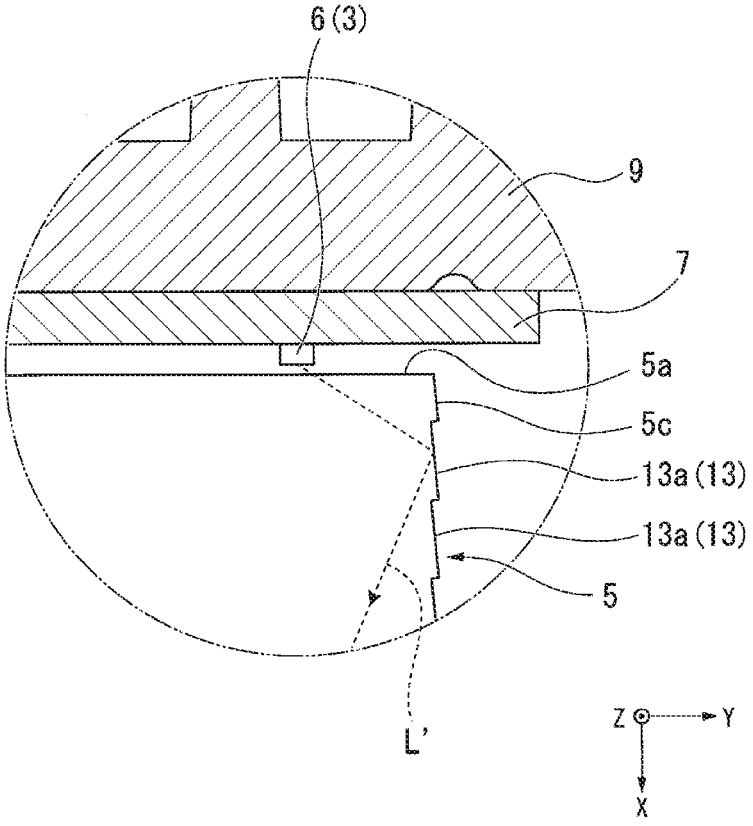
FIG. 15 is a cross-sectional view of the main part of a light guiding lens in which the enclosed portion A shown in FIG. 14 is enlarged.
Figure 16:
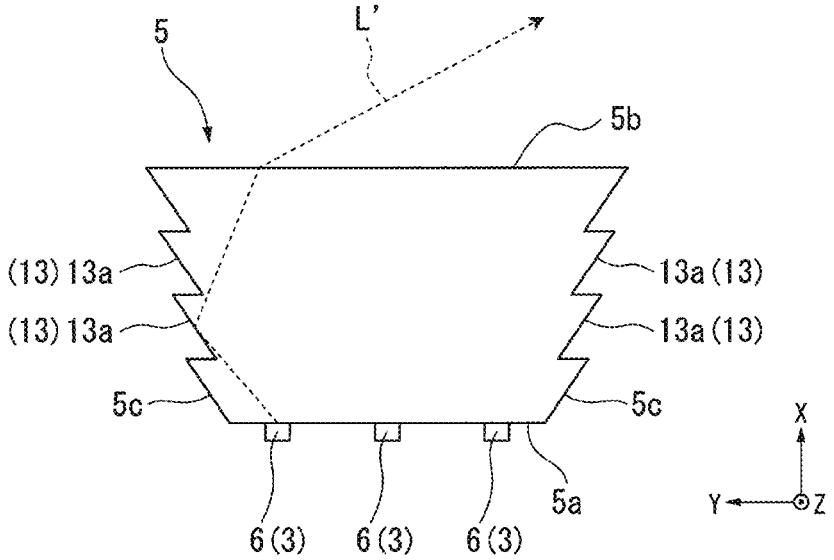
FIG. 16 is a cross-sectional view showing a configuration of a light guiding lens included in the vehicular lamp shown in FIG. 12.
Figure 17:
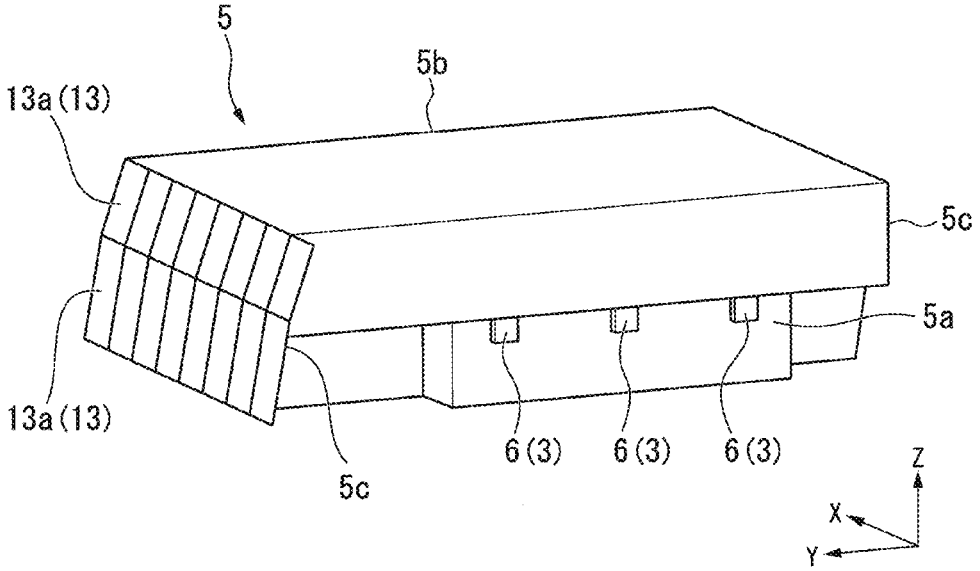
FIG. 17 is a perspective view showing a configuration of the light guiding lens included in the vehicular lamp shown in FIG. 12.

FIG. 12 is a perspective view showing the appearance of the vehicular lamp 1. FIG. 13 is an exploded perspective view showing the configuration of the vehicular lamp 1 of FIG. 12. FIG. 14 is a horizontal cross-sectional view showing the configuration of the vehicular lamp 1. FIG. 15 is a cross-sectional view of the main part of a light guiding lens in which the enclosed portion A shown in FIG. 14 is enlarged. FIG. 16 is a cross-sectional view showing the configuration of the light guiding lens included in the vehicular lamp 1. FIG. 17 is a perspective view showing the configuration of the light guiding lens included in the vehicular lamp 1.

In the vehicular lamp 1 of the present embodiment, for example, the present invention is applied to a vehicular headlamp mounted on both corner portions on the front end side of a vehicle body (not shown).

The basic configuration of the vehicular lamp 1 of the present embodiment is substantially the same as the configuration shown in FIGS. 1 and 2 etc., and detailed descriptions of the same components are omitted here while reference is made to the above description.

Also in the present embodiment, the projection lens 4 has a first lens surface 4*a* which is located on the side (rear side) facing the light source 3, and a second lens surface 4*b* which is located on the side (front side) facing the first lens surface 4*a*. The projection lens 4 enlarges and projects the light L from the light source 3 toward the front of the vehicle body (forward).

The first lens surface 4*a* is a convex surface on which the light L emitted from the light source 3 is incident. The first lens surface 4*a* has a convex shape curved in the left-right direction (Y-axis direction) and the up-down direction (Z-axis direction). The second lens surface 4*b* is a convex surface that outputs the light L entering through the first lens surface 4*a* forward. The second lens surface 4*b* has a convex shape curved in the left-right direction (Y-axis direction) and the up-down direction (Z-axis direction).

The projection lens 4 is sandwiched between the rear holder 11 and the front retainer 12, and the outer periphery thereof is retained by the holder 11 and the retainer 12. The projection lens 4 in this state is disposed in front of the light guiding lens 5.

The light guiding lens 5 has an outer shape smaller than that of the projection lens 4, and is disposed adjacent to the projection lens 4 in a state in which the optical axes of the projection lens 4 coincide with each other, i.e., has its optical axis coinciding with the optical axis of the projection lens 4. The light guiding lens 5 has an incident surface 5*a* which is located on the side (rear side) facing the light source 3, an output surface 5*b* which is located on the side (front side) facing the projection lens 4, and a reflection portion 13 which is located on the outer peripheral side surface 5*c* between the incident surface 5*a* and the output surface 5*b*.

The incident surface 5*a* is a flat plane on which the light L emitted from the light source 3 is incident. The output surface 5*b* is a concave surface configured to output the light L having been incident on and entered through the incident surface 5*a* toward the projection lens 4. The output surface 5*b* has a concave shape curved in the left-right direction (Y-axis direction) and the up-down direction (Z-axis direction) along the first lens surface 4*a* of the projection lens 4. The outer circumferential side 5*c* of the light-guiding lens 5 has a shape that is gradually widened from the incident surface 5*a* side to the output surface 5*b* side.

The reflection portion 13 has a plurality of reflection cuts 13*a* on the outer peripheral side surface 5*c* of the light guiding lens 5. The reflecting portion 13 reflects a part of the light L having entered through the incident surface 5*a* toward the output surface 5*b*. In addition, the light L' reflected by the reflecting portion 13 is output from the output surface 5*b* in a wider angle direction than the light L having been incident on and entered through the incident surface 5*a* and directed toward the output surface 5*b*.

As shown in FIG. 15, FIG. 16, and FIG. 17, the plurality of reflection cuts 13*a* are formed of a plurality of stepped surfaces periodically arranged in the front-rear direction of the outer peripheral side surface 5*c*. The stepped surfaces are inclined at angles at which they reflect the light L' having been incident on the outer peripheral side surface 5*c* toward the output surface 5*b*. In the reflecting portion 13, by adjusting the angles of the plurality of step surfaces (reflection cuts 13*a*) in the front-rear direction, the light distribution in the wider angle (wide-angle) direction of the light L' reflected toward the output surface 5*b* can be controlled.

The plurality of reflection cuts 13*a* are formed of a plurality of stepped surfaces divided in the vertical direction of the outer peripheral side surface 5*c*. In the reflecting portion 13, by adjusting the angles in the vertical direction of the plurality of step surfaces (reflection cuts 13*a*) divided in the vertical direction, the light distribution in the vertical direction of the light L' reflected toward the output surface 5*b* can be controlled.

In the present embodiment, light L' reflected toward the output surface 5*b* can be diffused in the vertical direction by the plurality of stepped surfaces (reflection cuts 13*a*) inclined at different angles in the vertical direction.

Figure 18:
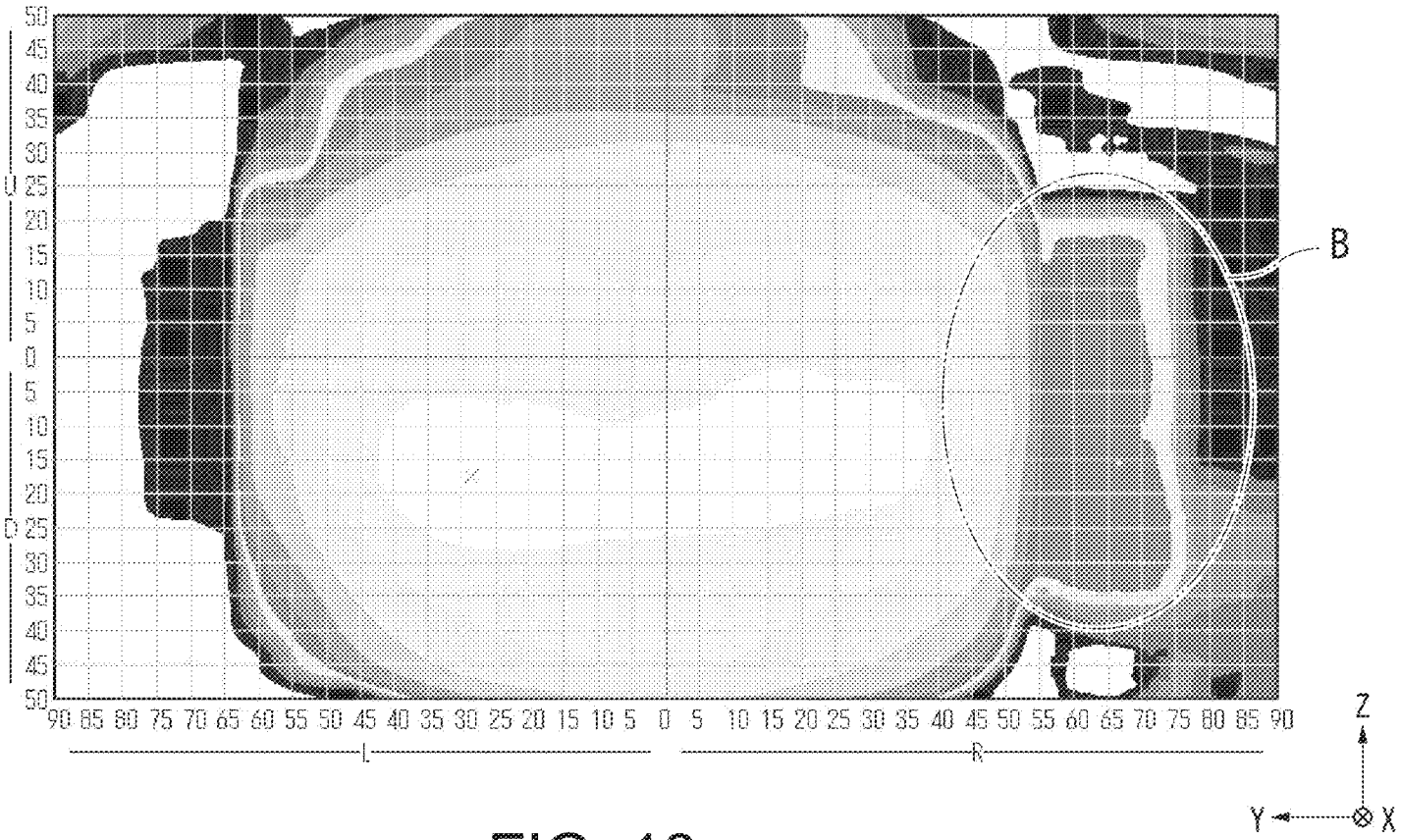
FIG. 18 is a schematic view showing a light distribution pattern formed on the surface of the virtual vertical screen by light projected forward in the vehicular lamp shown in FIG. 12.

FIG. 18 shows a light distribution pattern when light L (including light L') output from the projection lens 4 is projected onto a virtual vertical screen directly in front of the projection lens 4 in the vehicular lamp 1 having the above-described configuration.

In the vehicular lamp 1 of the present embodiment, in addition to the light distribution pattern formed by the light L projected forward by the projection lens 4, it is possible to add a light distribution pattern by the light L' directed in the wider angle direction as shown in the enclosed portion B in FIG. 18.

As described above, in the vehicular lamp 1 of the present embodiment, in addition to the light distribution (main light distribution) of the light L projected forward by the projection lens 4 described above, the light distribution (wide light distribution) of the light L' directed in the wide-angle (wide-angle) direction can be added, so that it is possible to improve the light distribution characteristics such as visibility.

Further, in the vehicular lamp 1 of the present embodiment, even when the wide-angle light distribution is added separately from the main light distribution described above, it is not necessary to add a new light source directed in the wide-angle direction, so that the light source unit 2 can be miniaturized compared to that for the conventional vehicular lamp.

The present invention is not necessarily limited to the embodiments described above, and various modifications can be made thereon without departing from the spirit of the present invention.

For example, although the light source unit 2 is configured to include the light guiding lens 5, the light guiding lens 5 may be omitted depending on the shape of the projection lens 4, e.g., a lens shape close to a sphere, and a part of the light entering through the first lens surface 4*a* of the projection lens 4 may be output from the output portion 14 in a direction different from the forward direction. Further, in the light source unit 2 described above, the projection lens 4 and the light guiding lens 5 are integrally combined to each other, but it is also possible to use the projection lens 4 and the light guiding lens 5 which are integrally formed as a one piece body.

The light source 3 may be any light emitting device as long as it emits light radially, and a light emitting element 6 such as a laser diode LD can be used in addition to the LED described above. The light source 3 descried above is not limited to the configuration using the plurality of light-emitting elements 6 described above, and may be configured using a single light-emitting element 6. The color of the light L emitted by the light emitting element 6 is not limited to the white light described above, and may be appropriately changed according to the use application of the light source 3, such as red light or orange light (amber).

In the above-described embodiments, the case where the present invention is applied to a vehicular headlamp has been exemplified, but the present invention can be applied not only to the vehicular lamp on the front side but also to a vehicular lamp on the rear side, such as a rear combination lamp, for example.

Examples of the vehicular lamp to which the present invention is applied may include, in addition to the above-described vehicular headlamp (headlamp), a wide variety of vehicular lamps such as a vehicle width lamp (position lamp), an auxiliary headlamp (sub-headlamp), a daylight lighting lamp (DRL), a tail lamp (rear lamp), a brake lamp (stop lamp), a backward movement lamp, a direction indicator (turn signal lamp), a front (rear) fog lamp, and a lid lamp, to which the above-described light source unit 2 can be used.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicular lamp comprising:

a light source configured to emit light in a forward direction; and a projection lens configured to project light emitted from the light source in the forward direction, wherein the projection lens includes:

a first lens surface which is located on a side facing the light source, and on which light emitted from the light source is incident, a second lens surface which is located on a side opposite to the first lens surface and configured to output light having been incident on and entered through the first lens surface in the forward direction, and an output portion which is located on an outer peripheral side surface between the first lens surface and the second lens surface and configured to output a part of light having been incident on and entered through the first lens surface in a direction different from the forward direction, the vehicular lamp further comprises a light guiding lens disposed between the light source and the projection lens, the light guiding lens includes an incident surface which is located on the side facing the light source, and on which light emitted from the light source is incident, an output surface which is located on the side facing the projection lens and configured to output light having been incident on and entered through the incident surface toward the projection lens, and a reflection portion which is located on an outer peripheral side surface between the incident surface and the output surface and configured to reflect a part of light having been incident on and entered through the incident surface toward the output surface, and the light reflected by the reflection portion is output from the output surface in a wider angle direction than a direction in which the light entering through the incident surface is directly directed to the output surface.

2. The vehicular lamp according to claim 1, wherein the output portion has a refracting surface configured to refract the light incident on the output portion.

3. The vehicular lamp according to claim 1, wherein the light guiding lens is disposed adjacent to the projection lens, and the output surface has a shape along the first lens surface.

4. The vehicular lamp according to claim 3, wherein the first lens surface and the second lens surface are each a convex surface, and the incident surface is a flat surface and the output surface is a concave surface.

5. The vehicular lamp according to claim 1, wherein the reflection portion has a plurality of reflection cuts on the outer peripheral surface of the light guiding lens.

6. The vehicular lamp according to claim 5, wherein the light guiding lens has an outer shape smaller than that of the projection lens and has an optical axis that coincides with an optical axis of the projection lens.

7. The vehicular lamp according to claim 1, wherein the light guiding lens has an outer shape smaller than that of the projection lens and has an optical axis that coincides with an optical axis of the projection lens.

8. The vehicular lamp according to claim 1, wherein the light source includes a plurality of light emitting elements and a circuit board on which the plurality of light emitting elements are mounted, and the plurality of light emitting elements are mounted on the same surface of the circuit board.

9. A vehicular lamp comprising:

a light source configured to emit light in a forward direction;

a projection lens configured to project light emitted from the light source in the forward direction; and a light guiding lens disposed between the light source and the projection lens, wherein the light guiding lens includes an incident surface which is located on a side facing the light source, and on which light emitted from the light source is incident, an output surface which is located on a side facing the projection lens and configured to output light having been incident on and entered through the incident surface toward the projection lens, and a reflection portion which is located on an outer peripheral side surface between the incident surface and the output surface and configured to reflect a part of light having been incident on and entered through the incident surface toward the output surface, and the light reflected by the reflection portion is output from the output surface in a wider angle direction than in a direction in which the light entering through the incident surface is directly directed to the output surface.

10. The vehicular lamp according to claim 9, wherein the reflection portion has a plurality of reflection cuts on the outer peripheral surface of the light guiding lens.

11. The vehicular lamp according to claim 10, wherein the light guiding lens has an outer shape smaller than that of the projection lens and has an optical axis that coincides with an optical axis of the projection lens.

12. The vehicular lamp according to claim 9, wherein the light guiding lens has an outer shape smaller than that of the projection lens and has an optical axis that coincides with an optical axis of the projection lens.

13. The vehicular lamp according to claim 9, wherein the projection lens includes a first lens surface which is located on a side facing the light source, and on which light emitted from the light source is incident, and a second lens surface which is located on a side opposite to the first lens surface and configured to output light having been incident on and entered through the first lens surface in the forward direction, the light guiding lens is disposed adjacent to the projection lens, and the output surface of the light guiding lens has a shape along the first lens surface.

14. The vehicular lamp according to claim 13, wherein the first lens surface and the second lens surface are each a convex surface, and the incident surface is a flat surface and the output surface is a concave surface.

15. The vehicular lamp according to claim 5, wherein the light source includes a plurality of light emitting elements and a circuit board on which the plurality of light emitting elements are mounted, and the plurality of light emitting elements are mounted on the same surface of the circuit board.

* * * * *